US006524087B1

(12) United States Patent
Eisenmann et al.

(10) Patent No.: US 6,524,087 B1
(45) Date of Patent: Feb. 25, 2003

(54) HYDROSTATIC PLANETARY ROTATION MACHINE HAVING AN ORBITING ROTARY VALVE

(76) Inventors: Siegfried A. Eisenmann, Conchesstrasse 25, D7960, Aulendorf (DE); Herman Härle, Conchesstrasse 23, D-7960, Aulendorf (DE)

( * ) Notice: Subject to any disclaimer, the term of this patent is extended or adjusted under 35 U.S.C. 154(b) by 0 days.

(21) Appl. No.: 09/631,971

(22) Filed: Aug. 3, 2000

(51) Int. Cl.[7] ..... F01C 1/10
(52) U.S. Cl. ..... 418/61.3
(58) Field of Search ..... 418/61.3

(56) References Cited

U.S. PATENT DOCUMENTS 3,106,163 A * 10/1963 Mosbacher ..... 418/61.3
4,741,681 A * 5/1988 Bernstrom ..... 418/61.3

FOREIGN PATENT DOCUMENTS

CH 679062 12/1991
EP 761968 3/1997

* cited by examiner

*Primary Examiner*—John J. Vrablik
(74) *Attorney, Agent, or Firm*—Rothwell, Figg, Ernst & Manbeck

(57) ABSTRACT

A hydrostatic planetary rotation machine has a displacer part (1) acting as a drive part or power take-off part and a rotary valve (3) serving for supplying working fluid to and removing said fluid from the displacer part (1), the displacer part (1) having a first rigid housing part (4) having a first inner tooth system (5) with a number d of teeth, which cooperates with a first outer tooth system (7), having a number c of teeth, on a rotatable, eccentrically arranged rotary piston (6). The rotary piston (6) has a second inner tooth system (8) which has a number b of teeth and meshes with a second outer tooth system (9), having a number a of teeth, on a centrically mounted shaft (2). Here, d−c=1 and b−a=2. Shaft bearings (10, 11) are arranged directly adjacent on the left and right of the displacer part (1). A disc-like rotary valve (3) is driven by means of a toothed gear which is in the form of an eccentric internal gear (12, 13) in which the disc-like rotary valve (3) executes the eccentric movement in orbit about the machine axis.

9 Claims, 3 Drawing Sheets

HYDROSTATIC PLANETARY ROTATION MACHINE HAVING AN ORBITING ROTARY VALVE

BACKGROUND OF THE INVENTION

1. Field of the Invention

The invention relates to a hydrostatic planetary rotation machine.

2. Description of the Related Art

Such a planetary rotation machine is described, for example, in EP-A1-761 968. In this machine, the displacer part and the control part are arranged between the shaft bearings for the drive shaft or power take-off shaft passing through both parts. The advantage of this arrangement is that there is a large distance between the bearings, with the result that, in the case of additional radial forces at the outer end of the shaft, for example owing to belt or tooth forces or owing to wheel contact forces, the bearing loads are reduced. A further advantage of this machine is the substantially better mechanically-hydraulic starting efficiency compared with other known systems with the so-called orbital low-speed motors, which generally transmit the torque from the rotary piston to the output shaft by means of a cardan shaft.

However, it has been found that in the known machines, as, for example, according to CH-A5-679062 or EP-A1-0 761 968, a substantial pressure increase and hence power increase compared with the other orbital low-speed engines (high-torque engines) is not possible since the tooth force at the shaft, due to the high hydrostatic force of the rotary piston, results in excessive shaft sags, bending stresses and shear stresses. The bending of the shaft then additionally leads to tooth flank pressure unevenly distributed over tooth width, thus reducing the life of this gear.

It is the object of the invention to improve this machine so that it permits higher operating pressures and hence higher torques and powers compared with the known design while at the same time permitting a smaller number of components.

This results in lower manufacturing costs and a very compact design. A so-called high-torque motor for maximum pressure of about 400 bar and for a continuous pressure of 350 bar is desired. This requirement is associated with the fact that such hydro motors have to be operated with present-day axial and radial reciprocating pumps which are often used as controllable hydrostatic power units. This means that the machine can be designed substantially more robustly and at the same time the volumetric efficiency can be improved.

Although the embodiment of such a motor according to FIG. 4 of EP-Al-0 761 968 already meets this requirement to a certain extent, the embodiment as such-is relatively complicated, as shown further below.

If the roller bearings of that part of the shaft which is subjected to a high hydrostatic radial load—as also shown in the embodiment according to FIG. 4 of EP-Al-0 761 968—are arranged directly adjacent to one another and a small axial distance apart, the rotary valve must be driven directly by the shaft by means of a toothed gear which permits the rotary valve to rotate exactly and synchronously with the rotary piston of the displacer part. This is indispensable for the commutation of supply to and removal from the working cells of the orbital principle of such machines. In this way, the shaft sag and the skew position of the shaft tooth flanks under load are reduced in an advantageous manner. Furthermore, the shaft tooth system at the displacer part can be made exactly as broad as or even somewhat broader than that of the rotary piston. This was not possible in the case of known machines, as described, for example, in CH-A5-679062 because there a part of the force-transmitting tooth width on the shaft is lost owing to the engagement of the teeth of the connecting shaft from the rotary piston to the rotary valve. The tooth root bending stress and the specific tooth flank load can however be reduced by 15 to 20% by the measure described. A further advantage is the omission of the connecting shaft between the rotary piston and the rotary valve, which accounts for about 3 to 5% of the manufacturing costs.

It is the object of the invention to eliminate the disadvantages which have become evident from the prior art. This is achieved by a toothed gear which is an eccentric internal gear in which a disc-like rotary valve executes an eccentric movement in orbit about a machine axis.

SUMMARY OF THE INVENTION

According to the invention, a possible tooth gear is an eccentric internal gear in which the disc-like rotary valve executes the eccentric movement (orbital movement). The two internal gears which form the eccentric gear have differences in the number of teeth between one and two teeth, so that there is multiple tooth engagement, similarly to the displacer tooth system on the displacer part. The tooth shapes used may be cycloid internal tooth systems, in particular trochoidal tooth systems or, where the difference in the number of teeth is two teeth, also involute shaft tooth systems according to DIN 5480 with a 30° angle of pressure, if it is ensured that no tooth tip contact disturbances occur.

If the disc-like rotary valve is produced by a powder metallurgical sintering process, no additional manufacturing effort is required for these tooth systems. The tooth system on the shaft can be manufactured in an efficient manufacturing process in one chucking operation together with the shaft tooth system for the displacer part on program-controlled gear-cutting machines. If necessary, this gear wheel can also be mounted nonrotatably on the shaft by means of stamping or sintering. The hollow wheel with the internal tooth system in the housing part on the rotary valve is stamped or broached, it being possible to broach a large number of parts simultaneously. Here too, the manufacturing effort is thus minimized. In order to ensure identical speeds of rotary piston and rotary valve, the numbers of teeth on the tooth system should correspond to the equation $$\frac{\frac{b}{a}\cdot d - c}{d - c} = \frac{\frac{x}{w}\cdot z - y}{z - y}$$

where a is the number of teeth of the outer tooth system on the shaft, b is the number of teeth of the inner tooth system on the rotary piston, c is the number of teeth of the outer tooth system on the rotary piston, d is the number of teeth of the inner tooth system on the rigid housing part, w is the number of teeth on the first sun wheel on the shaft, x is the number of teeth of the inner tooth system on the rotary valve, y is the number of teeth of the outer tooth system on the rotary valve and z is the number of teeth on the second sun wheel in the form of a hollow wheel fixed to the housing. According to the invention, this equation should express an integer.

In contrast to the known embodiments of planetary rotation machines having a disc-like rotary valve, in the machine according to the invention, as mentioned above, the rotary valve executes a small eccentric movement. This may not adversely affect the proper commutation for the displacer part. It should be kept as small as possible. In the case of the reference diameter given by the overall design for the tooth systems of the eccentric gear, the common eccentricity is all the greater the lower the speed of the axis of eccentricity. Conversely, the speed of the eccentric axis is all the higher the smaller the chosen eccentricity. High speeds of the eccentric axis result in centrifugal forces on the rotary valve, with the result that the tooth systems are loaded and compression losses occur between the inner tooth systems. Preferred tooth system data are given by the value of the equation, $$\frac{y}{y-z}$$

assuming integral negative values between −33 and −55 if, on the eccentric gear, y denotes the number of teeth of the outer tooth system on a disc-like rotary valve and z denotes the number of teeth of the inner tooth system on an adjacent housing or on a second sun wheel in the adjacent housing.

A good compromise between the magnitude of the eccentricity and the speed of the eccentric axis is possible if, with the numbers of teeth a=12, b=14, c=11, d=12 or a=13, b=15, c=12, d=13 of the displacer part, the numbers of teeth of the eccentric gear of the rotary valve can assume the following values:

for (x−w)=1:x=16 to 24; y=29 to 45 teeth for (x−w)=2:x=31 to 49; y=18 to 46 teeth.

Further, the common eccentricity of the eccentric gear on the disc-like rotary valve is 0.01 to 0.017 times the mean reference diameter of control slots in a control plate.

Finally, the common eccentricity of the two internal gears is 0.011 to 0.015 times the mean reference diameter of the control slots (21) in the control plate.

With these values, the centrifugal forces on the rotary valve are still low, but at the same time the commutation conditions are improved in a large range of angles of rotation of the rotary piston for machine operation with low torque-pulsation and for a good volumetric efficiency.

The differential piston hydraulically compensates the axial forces at the disc-like rotary valve, so that, in both directions of rotation, the leakage gap between the rotary valve and the control plate on the one hand and the rotary valve and the end face of the differential piston on the other hand is reduced to a lubricating film thickness of a few micrometers. In this way, the volumetric efficiency of the machine remains very high even at high pressures and low speeds.

BRIEF DESCRIPTION OF THE DRAWINGS

The invention is described below purely by way of example with reference to drawings.

DETAILED DESCRIPTION OF THE PREFERRED EMBODIMENT

Figure 1:
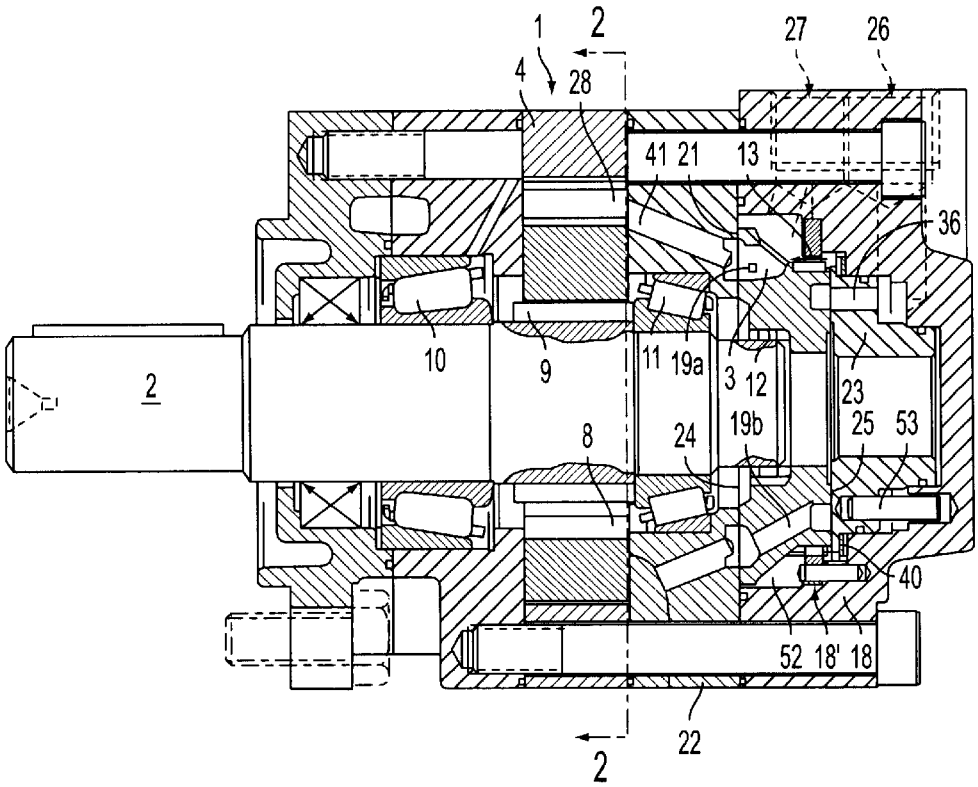
FIG. 1 shows a longitudinal section through a planetary rotation machine according to the invention.

The planetary rotation machine shown in the Figures has a drive shaft or power take-off shaft 2 where the bearings 10 are arranged directly on either side of a rigid housing part 4. The shaft 2 is provided, in the region of the rigid housing part 4 acting as a displacer part, with a—second—outer tooth system 9 having a number a of teeth, which tooth system meshes with a—second—inner tooth system 8 having a number b of teeth on the rotary piston 6. The rotary piston 6 revolves eccentrically about the shaft 2 and meshes with a—first—outer tooth system 7 having a number c of teeth in the—first—inner tooth system 5 of the rigid housing part 4, which tooth system has a number d of teeth.

To increase the life of the displacer tooth system between rotary piston 6 and housing part 4, the—first—inner tooth system 5 on the housing part 4 can be advantageously designed in the form of rollers 28 rotatably mounted on sliding bearings. Working spaces 31*a* and 31*b* are between rotary piston 6 and housing part 4.

The respective load-free rollers on the high-pressure side, corresponding to working space 31*a*, permit the build-up of a lubricating film between roller 28 and housing 4, which with periodic relief of the roller 28 produces a supporting squeeze film (squeeze effect). A genuine hydrodynamic sliding bearing is therefore present.

A toothed gear in the form of an eccentric internal gear 12, 13 is provided for transmitting the rotary piston revolution to the rotary valve 3, this toothed gear generating a gear ratio by means of which the gear ratio in the torque transmission from the rotary piston 6 to the shaft 2 is compensated. The portion of control part 22 driven in this manner and in the form of the rotary valve 3 is designed in the form of a disc. If the embodiment according to the invention and in accordance with the present FIG. 1 and FIG. 5 is compared with the embodiment disclosed in EP-AI-761 968, FIG. 4, it is easy to see that the embodiment according to the invention has fewer components (thus, the gear piston 15', the transmission sleeve 42 and also the housing part 9 of the known embodiment could be dispensed with), with the result that the manufacturing costs are reduced. Furthermore, the size of the motor can thus be chosen smaller.

Figure 4:
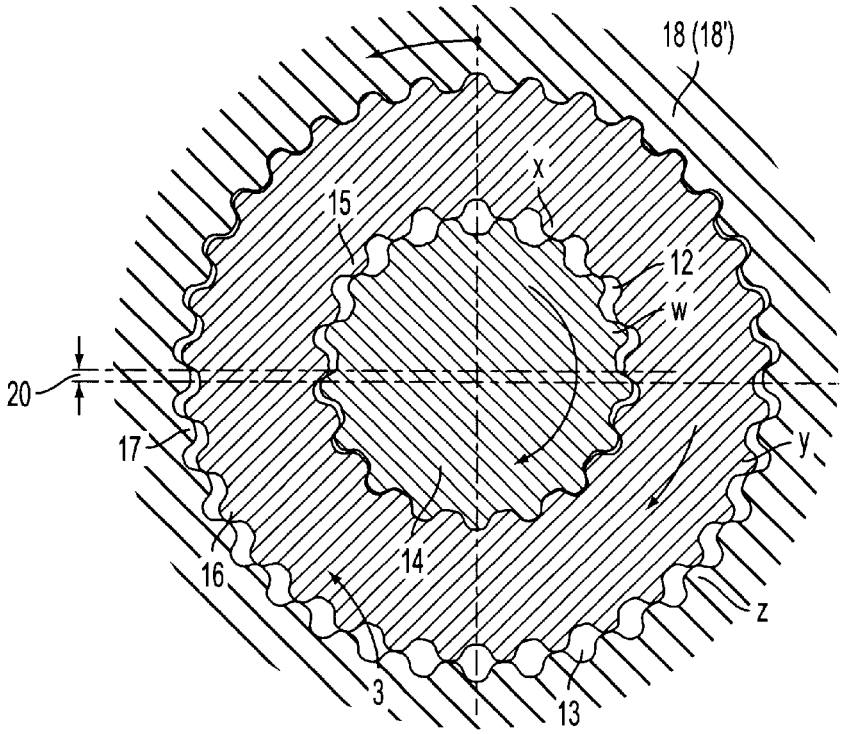
FIG. 4 shows a schematic diagram of a rotary valve according to the invention.
Figure 5:
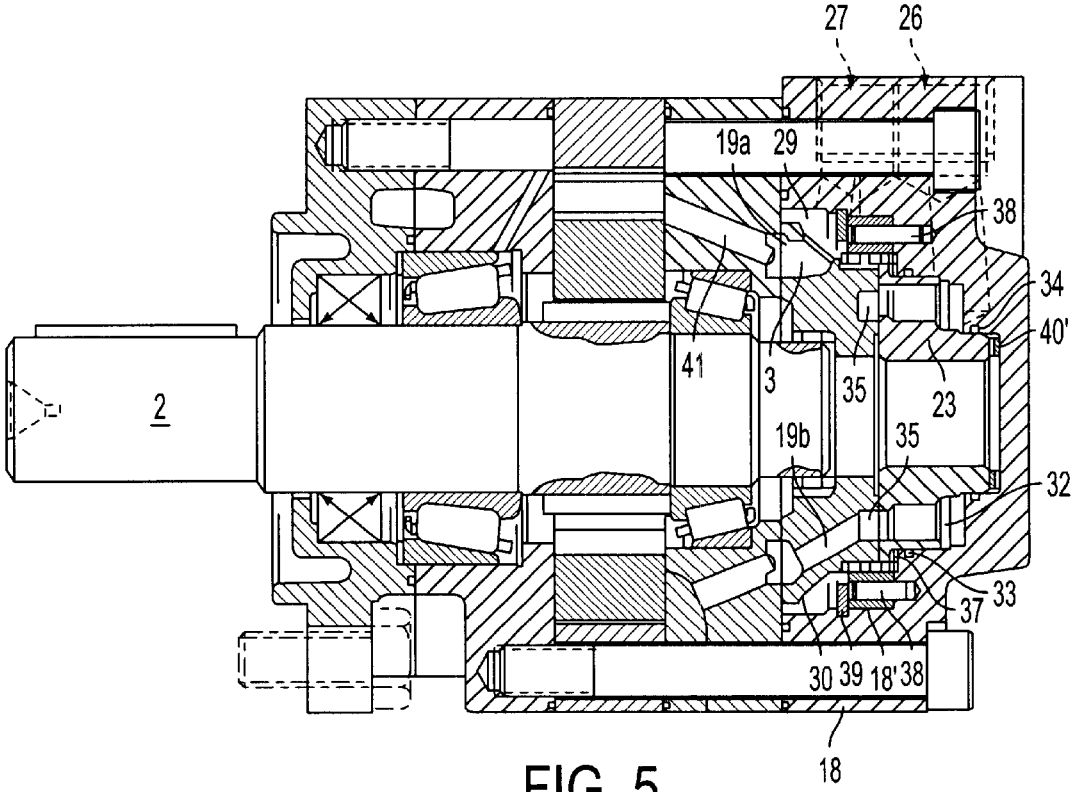
FIG. 5 shows a longitudinal section, corresponding to FIG. 1, of a further embodiment

FIG. 4 schematically shows the design and mode of operation of the rotary valve 3. The shaft 2 is in the form of a first sun wheel 14 which has a number w of teeth and in which the disc-like rotary valve rotates, with meshing, by its—third—inner tooth system 15 having a number x of teeth and an eccentricity 20. The—third—outer tooth system 16 of the rotary valve 3, having a number y of teeth, now meshes with a—fourth—inner tooth system 17 which is designed in the form of a hollow wheel which is fixed in the adjacent housing 18 on a second sun wheel $\mathbf{18}^1$. The number of teeth of this—fourth—inner tooth system 17 on the second sun wheel $\mathbf{18}^1$ is denoted by z. As described further below, the inner tooth system provided on the second sun wheel can also be arranged directly on the adjacent housing, with the result that it is possible to dispense with the sun wheel as a separate component, although fixed to the housing.

With clockwise operation of the machine, oil under high pressure is introduced into the connection 27 and hence into the annular space 52 and channel 19*a* in rotary valve 3, and then into passages 41 in control part 22 to the high pressure side working spaces 31*a*. Oil from the low-pressure side working spaces 31*b* exits through passages 41 into channels 19*b* in rotary valve 3, and then into annular space 35 and connection 26. The conical design of the rotary valve 3 provides an annular axial surface 30 (FIG. 5) which, in this operating state of the machine, can compensate the axial force at the leakage gap 24. Thus, the rotary valve 3 always remains at zero play at the leakage gap 24 if the axial surface 30 is correctly dimensioned.

Figure 3:
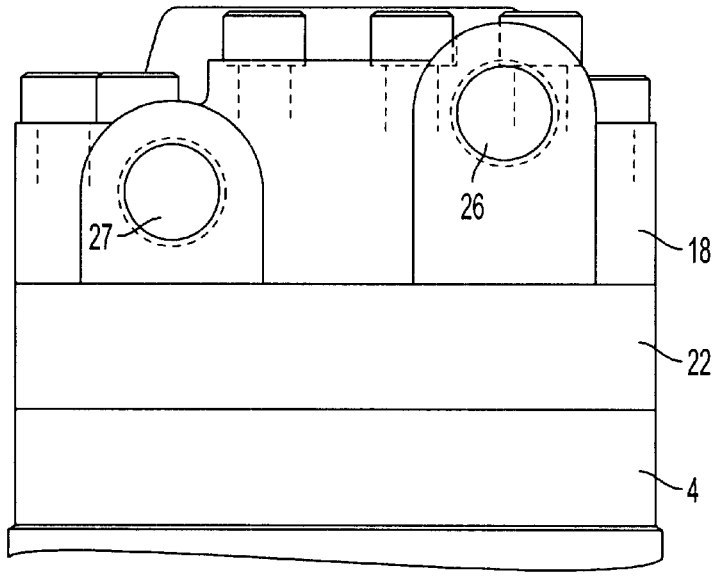
FIG. 3 shows a partial view corresponding to FIG. 1, viewed from above.

The situation is different when, with counterclockwise operation, the oil under high pressure is introduced into the connection 26 (FIG. 1 and FIG. 3). In this case, the pressurized oil comes into contact with the piston ring surface 32 formed on a differential piston 23. This differential piston 23 is provided for axial compensation of the leakage gaps 24 and 25 at the rotary valve 3. Since the differential piston 23 is sealed by 0-rings 33 and 34 in an axially displaceable manner in the adjacent housing 18, said piston is pressed against the leakage gap 25 to seal a further annular space 35 coordinated with the piston ring surface. Annular space 35 is connected to channel 19*b* and therefore to channel 26. The axial force generated by the differential piston 23 thus simultaneously seals the leakage gap 24 and the leakage gap 25. The function and dimensioning of such a differential piston 23 is known to a person skilled in the art and therefore requires no further explanation.

According to the invention, a novel embodiment of the differential piston 23 is shown in FIG. 5. The differential piston 23 must be secured to prevent rotation in the adjacent housing 18. In the embodiment according to FIG. 1, a pin 53 serves for this purpose. However, in this case no connecting hole 36 in the differential piston 23 can be provided at this point, which increases the flow resistance for the oil. Furthermore, the circumferential force of the pin 35 against the adjacent housing 18, which is caused by the frictional torque between the revolving rotary valve 3 and the differential piston 23, is the higher the higher the operating pressure of the machine, since the axial force on the piston ring surface 32 increases.

This circumferential force hinders the axial mobility of the differential piston 23 in a disadvantageous manner. In FIG. 5, the second sun wheel $\mathbf{18}^1$ in the form of a hollow wheel is advantageously somewhat broader. Thus, a tooth system 37 provided on the differential piston 23 can engage said sun wheel so that the differential piston 23 can be secured to prevent rotation, without transverse forces. The differential piston 23, together with its tooth system 37 and the connecting holes 36, can be produced by the sintering process. This embodiment is very easy to assemble since the differential piston 23 can be inserted when the 0-rings 33 and 34 have been arranged in the adjacent housing 18. The second sun wheel $\mathbf{18}^1$ is secured to prevent rotation by means of pins 38 and is secured axially by means of a circlip 39. An initial spring $\mathbf{40}^1$ is in the form of an ondular washer and keeps the differential piston 23 in contact with the rotary valve 3 also at zero pressure.

Figure 2:
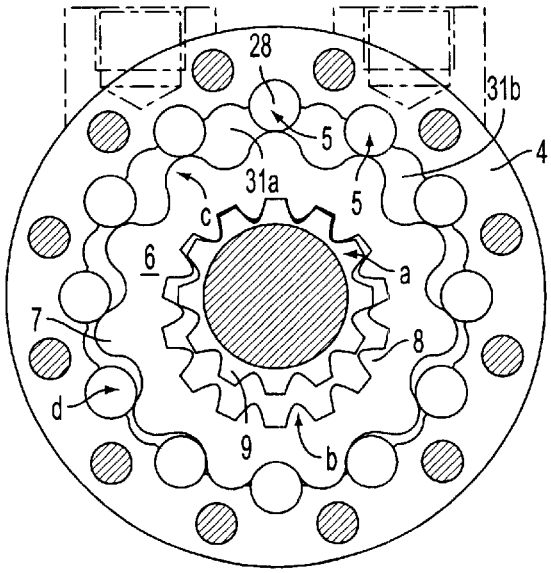
FIG. 2 shows a cross-section along 2—2 of FIG. 1.
Figure 6:
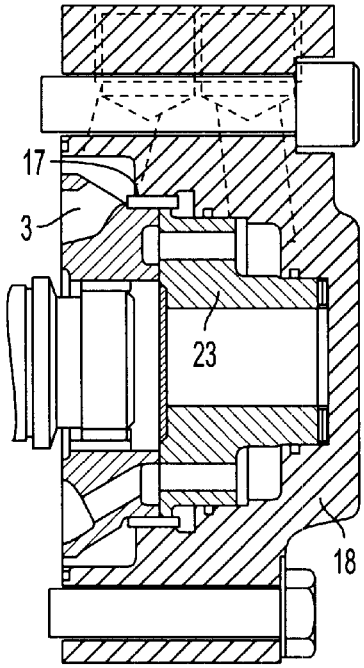
FIG. 6 shows a partial longitudinal section through a further embodiment.

As shown in FIG. 6, the fourth inner tooth system 17 can also be arranged directly in the adjacent housing 18. This will prove advantageous in particular if a sufficient capacity in terms of gear cutting machines is available to the manufacturer of such planetary rotation machines. Such an arrangement has the advantage that the internally geared sun wheel $\mathbf{18}^1$ and small parts, such as pins 38 and circlip 39 can be dispensed with. Furthermore, the assembly effort is reduced. In the case of the embodiment according to FIG. 6, it should be ensured that the rotational phase position of the tooth system 17 relative to the second inner tooth system 5 (which, according to FIG. 2, may be in the form of rollers) is exactly maintained, which object is achieved in the embodiments according to FIG. 1 and FIG. 5 by the correct positioning of the pin 38.

The slight eccentric movement of the rotary valve 3 is very advantageous tribologically because the formation of grooves by dirt particles and abraded particles in the oil film is thus avoided, as in the polishing of smooth surfaces. The unavoidable wear by erosion and corrosion on these surfaces is automatically compensated by the differential piston 23 pressed on hydrostatically. Thus, the leakage stream at these points is always small.

In one embodiment, the hydrostatic planetary rotation machine includes a displacer part 1 acting as a drive part or power take-off part and comprising a disc-like rotary valve 3 serving to supply working fluid and remove working fluid from the displacer part 1. The displacer part 1 has a first rigid housing 4 having a first inner tooth system 5 with a number d of teeth, which cooperates with a first outer tooth system 7, having a number c of teeth, on a rotatable, eccentrically arranged rotary piston 6. The rotary piston 6 has a second inner tooth system 8 which has a number b of teeth and meshes with a second outer tooth system 9, having a number a of teeth, on a centrically mounted shaft 2, where d−c=1 and b−a=2. Shaft bearings 10, 11 are arranged directly adjacent on the left and right of the displacer part 1. A disc-like rotary valve 3 and a toothed gear for driving said valve are provided in which the toothed gear is an eccentric internal gear 12, 13 and in which the disc-like rotary valve 3 executes an eccentric movement in orbit about the machine axis.

In another embodiment the numbers a, b, c, d of teeth of the displacer part 1 and the numbers w, x, y, z of teeth of the eccentric internal gear 12, 13 fulfil the equation $$\frac{\frac{b}{a}\cdot d - c}{d-c} = \frac{\frac{x}{w}\cdot z - y}{z-y}$$

and this equation expresses a positive integer, where w denotes the number of teeth of a first sun wheel 14 arranged on the shaft 2, x denotes the number of teeth of the third inner tooth system 15 on the disc-like rotary valve 3, y denotes the number of teeth of the third outer tooth system 16 on the rotary valve 3 and z denotes the number of teeth of the fourth inner tooth system 17 on the adjacent housing 18.

In another embodiment, the positive integer is equal to 3.

In another embodiment, the value of the equation, $$\frac{y}{y-z}$$

assumes integral negative values between −33 and −55 if, on the eccentric gear 12, 13, y denotes the number of teeth of the outer tooth system 16 on the disc-like rotary valve 3 and z denotes the number of teeth of the inner tooth system 17 on the adjacent housing 18 or on a second sun wheel $\mathbf{18}^1$ in the adjacent housing 18.

In another embodiment, with the numbers of teeth a=12, b=14, c=11, d=12 or a=13, b=15, c=12, d=13 of the displacer part 1, the numbers of teeth of the eccentric gear 12, 13 of the rotary valve 3 can assume the following values:

for x−w=1: x=16 to 24; y=29 to 45 teeth, for x−w=2: x=31 to 49; y=18 to 46 teeth.

In another embodiment, the common eccentricity 20 of the eccentric gear 12, 13 on the, disc-like rotary valve 3 is 0.01 to 0.017 times the mean reference diameter of control slots 21 in a control plate 22.

In another embodiment, the common eccentricity 20 of the eccentric gear 12, 13 on the, disc-like rotary valve 3 is 0.01 to 0.017 times the mean reference diameter of control slots 21 in a control part 22. Control part 22 includes passages 41 leading to inlets 29, as shown in FIGS. 1 and 5.

In another embodiment, a differential piston 23 is provided for axial compensation of leakage gaps 24 and 25 in the disc-like rotary valve 3.

In another embodiment, the first inner tooth system 5 is formed by rollers 28 rotatably mounted in the housing part 4.

We claim:

1. Hydrostatic planetary rotation machine comprising a displacer part (1) acting as a drive part or power take-off part and comprising a disc-like rotary valve (3) serving for supplying working fluid 2 and removing said fluid from the displacer part (1), the displacer part (1) having a first rigid housing (4) having a first inner tooth system (5) with a number d of teeth, which cooperates with a first outer tooth system (7), having a number c of teeth, on a rotatable, eccentrically arranged rotary piston (6), the rotary piston (6) having a second inner tooth system (8) which has a number b of teeth and meshes with a second outer tooth system (9), having a number a of teeth, on a centrically mounted shaft (2), where d−c=1 and b−a=2, shaft bearings (10, 11) being arranged directly adjacent on the left and right of the displacer part (1) and the disc-like rotary valve (3) and a toothed gear for driving said valve being provided, characterized in that the toothed gear is an eccentric internal gear (12, 13) in which the disc-like rotary valve (3) executes an eccentric movement in orbit about the machine axis.

2. Hydrostatic planetary rotation machine according to claim 1, characterized in that the value of the equation, $$\frac{y}{y-z}$$

assumes integral negative values between −33 and −55 if, on the eccentric gear (12, 13), y denotes the number of teeth of an outer tooth system (16) on the disc-like rotary valve (3) and z denotes the number of teeth of an inner tooth system (17) on the adjacent housing (18) or on a second sun wheel ($18^1$) in the adjacent housing (18).

3. Hydrostatic planetary rotation machine according to claim 1, characterized in that a common eccentricity (20) of the eccentric gear (12, 13) on the disc-like rotary valve (3) is 0.01 to 0.017 times the mean reference diameter of control slots (21) in a control plate (22).

4. Hydrostatic planetary rotation machine according to claims 1, characterized in that a common eccentricity (20) of the eccentric internal gears (12, 13) is 0.011 to 0.015 times the mean reference diameter of control slots (21) in a control plate (22).

5. Hydrostatic planetary rotation machine according to claim 1, characterized in that a differential piston (23) is provided for axial compensation of leakage gaps (24 and 25) in the disc-like rotary valve (3).

6. Hydrostatic planetary rotation machine according to claim 1, characterized in that the first inner tooth system (5) is formed by rollers (28) rotatably mounted in the housing part (4).

7. Hydrostatic planetary rotation machine according to claim 1, characterized in that the numbers (a, b, c, d) of teeth of the displacer part (1) and the numbers (w, x, y, z) of teeth of the eccentric internal gear (12, 13) fulfil the equation $$\frac{\frac{b}{a}\cdot d-c}{d-c}=\frac{\frac{x}{w}\cdot z-y}{z-y}$$

and this equation expresses a positive integer, where w denotes the number of teeth of a first sun wheel (14) arranged on the shaft (2), x denotes the number of teeth of a third inner tooth system (15) on the disc-like rotary valve (3), y denotes the number of teeth of a third outer tooth system (16) on the rotary valve (3) and z denotes the number of teeth of a fourth inner tooth system (17) on the adjacent housing (18).

8. Hydrostatic planetary rotation machine according to claim 7, characterized in that the positive integer is equal to 3.

9. Hydrostatic planetary rotation machine according to claim 2, characterized in that, with the numbers of teeth a=12, b=14, c=11, d=12 or a=13, b=15, c=12, d=13 of the displacer part (1), the numbers of teeth of the eccentric gear (12, 13) of the rotary valve (3) can assume the following values: for (x−w)=1: x=16 to 24; y=29 to 45 teeth for (x−w)=2: x=31 to 49; y=18 to 46 teeth.

* * * * *